United States Patent [19]

Uchinuma et al.

[11] 4,248,726

[45] Feb. 3, 1981

[54] HIGH-VISCOSITY REFRIGERATOR OIL COMPOSITIONS

[75] Inventors: Kazuo Uchinuma, Tokyo; Umekichi Sasaki, Kawasaki, both of Japan

[73] Assignees: Nippon Oil Co., Ltd.; Mitsubishi Jukogyo Kabushiki Kaisha, both of Tokyo; Sanyo Chemical Industries, Ltd., Kyoto, all of Japan

[21] Appl. No.: 903,323

[22] Filed: May 5, 1978

[30] Foreign Application Priority Data

May 13, 1977 [JP] Japan ..... 52-55166

[51] Int. Cl.[3] ..... C10M 3/20; C10M 3/18; C10M 3/14

[52] U.S. Cl. ..... 252/52 A; 252/52 R; 252/56 S; 252/56 R; 252/68

[58] Field of Search ..... 252/52 R, 52 A, 56 R, 252/56 S, 68

[56] References Cited

U.S. PATENT DOCUMENTS

| | | | |
|---|---|---|---|
| 1,779,460 | 10/1930 | Bagley | 252/52 A |
| 1,984,421 | 12/1934 | Muench et al. | 252/52 A |
| 2,552,084 | 5/1951 | Bishop et al. | 252/68 |
| 2,582,306 | 1/1952 | Zellhoefer et al. | 252/68 |
| 3,652,411 | 3/1972 | Commichau | 252/52 A |

*Primary Examiner*—Delbert E. Gantz
*Assistant Examiner*—Irving Vaughn
*Attorney, Agent, or Firm*—Jordan and Hamburg

[57] ABSTRACT

A high-viscosity refrigerator oil composition comprising (A) a polyglycol oil such as a polyoxypropylene glycol or an alkyl ether thereof and (B) 0.1–10% by weight, based on the total weight of (A) and (B), of a glycidyl ether type epoxy compound, an epoxidized fatty acid monoester and/or an epoxidized vegetable oil.

7 Claims, No Drawings

HIGH-VISCOSITY REFRIGERATOR OIL COMPOSITIONS

This invention relates to a high-viscosity refrigerator oil composition and more particularly it relates to such a refrigerator oil composition having excellent sealability as well as excellent viscosity characteristics which are still retained even at high temperatures in the presence of a halogen-containing refrigerant.

Heretofore, various kinds of refrigerators have been used and, among other things, compression-type refrigerators depend for their refrigerating performance upon the extent of sealability between a low pressure suction gas and a high pressure delivery gas. Thus, refrigerator oils for compression-type refrigerators are required to have satisfactory sealability. With the recent progress of refrigerators in performance, the delivery gas to be discharged therefrom is higher in temperature, thereby resulting in an decrease of the refrigerator oil in viscosity and consequently in sealability. Compressor-type refrigerators are structurally classified into reciprocation type, centrifugal type and rotary type ones. The rotary type refrigerators are inferior in sealability because of their structure and, especially, screw type refrigerators have a large gap in their sealing mechanism, this requiring a refrigerator oil having excellent sealability.

In addition, as a refrigerator oil there have heretofore been generally used a naphthenic mineral oil, a low pour point paraffinic mineral oil and an alkylbenzene each having a kinematic viscosity of 20–150 cSt at 37.8° C., and a mixture thereof. These various base oils incorporated with additives have also been generally used. The aforesaid conventional refrigerator oils are described in, for example, Japanese published patent applications 11940/65, 4107/74, 13483/74, 13829/74, 19084/74, 37647/76 and 45013/76 as well as Japanese laid-Open patent applications 4532/71, 47498/74, 606/73, 34903/74, 97351/74 and 22971/76. However, these conventional refrigerator oils do not exhibit satisfactory viscosity at high temperatures nor do they exhibit satisfactory sealability and excellent performances even when they are used as a refrigerator oil for rotary type refrigerators.

A primary object of this invention is to provide a high-viscosity refrigerator oil especially suitable for rotary type refrigerators, particularly such refrigerator oil which meets the following three requirements:

(a) high viscosity at high temperatures and excellent sealability, (b) slight variation in viscosity with a change in temperature, maintenance of suitable viscosity at ambient and even low temperatures and, therefore, excellent operativeness, and (c) stable maintenance of the aforesaid viscosity characteristics even when in use at a high temperature in the presence of a halogen-containing refrigerant.

Researches and studies were made by the present inventors in an attempt to obtain refrigerator oils meeting the aforesaid requirements and, as a result, it has been found that polyglycol oils having a kinematic viscosity of 50–200 cSt at 98.9° C. and a viscosity index of at least 150 meet the aforesaid requirements (a) and (b), and that a composition prepared by incorporating the polyglycol oil with at least one compound selected from the group consisting of glycidyl ether type epoxy compounds (1), epoxidized fatty acid monoesters (2) and epoxidized vegetable oils (3) will not lower in viscosity, retain the desirable viscosity characteristics of the polyglycol oil for a long period of time and have high sealability even when the composition is used at a high temperature in the presence of a halogen-containing refrigerant, thus meeting all of the said requirements (a), (b) and (c). This invention is based on this finding or discovery.

It is known that polyglycol oils may be used as a refrigerator oil. For example, K. S. Sanvordenker et al (ASHRAE Symposium Nasso, June 29, 1972) indicated that polyglycol diethers of a 100 SUS grade having a viscosity of 102 SUS (21.0 cSt) at 37.8° C. and a viscosity of 44 SUS (5.3 cSt) at 98.9° C., as well as polyglycol monoethers of a 165 SUS grade may be used as a refrigerator oil and, in addition, J. M. Russ et al (Lubrication Engineering Vol. 2, 151) indicated that polyglycol oils "UCON" having a viscosity of 5.9–22.0 cSt at 98.9° C. and a viscosity index of 140–147 may be used as a refrigerator oil. However, known refrigerator oils containing these polyglycol oils are not satisfactory in viscosity at high temperatures and in sealability. Even if polyglycol oils having a high viscosity be used, they will not be able to retain the original sealability because they decrease in viscosity during their use.

Synthetic oils such as polybutene oils and poly$\alpha$-olefin oil, are known as lubricating oils which retain satisfactory viscosity even at high temperatures. However, these synthetic oils cannot be used at a low temperature because of their high viscosity at this temperature and, to overcome this disadvantage, they may be incorporated with a viscosity index improver such as a polymethacrylate, polyisobutylene or ethylene-propylene copolymer. The synthetic oils so incorporated will deposit therefrom the viscosity index improver in the tubing system of a refrigerator and decrease in viscosity due to mechanical shearing of the viscosity index improver, this rendering the oils unsuitable for use as a refrigerator oil.

On the other hand, Japanese Laid-Open patent application 97351/74 discloses the addition to a refrigerator oil a dehydrochlorinating agent typified by an epoxide. In addition, Japanese published patent application 8926/61 illustrates the use, as a diesel engine oil, of a lubricating incorporated with 2 wt.% of an arylglycide ether having as the substituent an alkyl group containing up to 4 or not less than 12 carbon atoms. However, these known applications do not refer to anything about the addition of an epoxide to a high-viscosity polyglycol and the effect obtainable by said addition.

The high-viscosity refrigerator oil composition of this invention comprises:

(A) a polyglycol oil having a kinematic viscosity of 50–200 cSt at 98.9° C. and a viscosity index of at least 150, represented by the following formula $$R_1\text{-}[O\text{—}(R_2O)_m\text{—}R_3]_n$$

wherein $R_1$ and $R_3$ are each a hydrogen atom, hydrocarbon radical or acyl group and they may be identical with, or different from, each other, $R_2$ is an alkylene group, n is an integer of 1–6 and mxn equals at least 30, and (B) 0.1–10% by weight, based on the total weight of (A) and (B), of at least one member selected from the group consisting of (1) glycidyl ether type epoxy compounds, (2) epoxidized fatty acid monoesters and (3) epoxidized vegetable oils.

The polyglycol oils used herein have a kinematic viscosity of 50–200 cSt and a viscosity index of at least 150 and are represented by the following formula (1)

$$R_1\text{-}[O\text{—}(R_2O)_m\text{—}R_3]_n \quad (1)$$

In the formula (1), $R_2$ is an alkylene group preferably having 2–8 carbon atoms and alkylene groups having different numbers of carbon atoms may be present in the molecule; preferable alkylene groups include ethylene and propylene groups, and preferable polyoxyalkylene groups include a polyoxypropylene group and polyoxyethylene-polyoxypropylene group.

In the formula (1), $R_1$ and $R_3$ is a hydrogen atom, hydrocarbon radical or acyl group and they may be identical or different.

The hydrocarbon radicals referred to herein include (i) saturated or unsaturated, straight-chain or branched-chain $C_1$–$C_{20}$ hydrocarbon radicals, preferably $C_1$–$C_{10}$ alkyl groups derived from $C_1$–$C_{10}$ aliphatic monohydric alcohols and particularly preferably methyl, ethyl, propyl, butyl, pentyl, octyl and decyl groups, (ii) hydrocarbon radicals derived from di- to hexahydric alcohols, preferably glycol, glycerine, trimethylolpropane, pentaerithritol and sorbitol and (iii) substituted or unsubstituted aromatic hydrocarbon radicals, preferably phenyl, octylphenyl and nonylphenyl groups. The acyl groups referred to herein include ones derived from carboxylic acids, preferably saturated and unsaturated carboxylic acids such as acetic, propionic, butyric, lauric, stearic and oleic acids.

In the formula (1), n is an integer of 1–6, preferably 1–3, and mxn equals at least 30, preferably at least 50.

The particularly preferable polyglycol oils used herein include polyoxypropylene glycols, polyoxyethylenepolyoxypropylene glycols as well as their monomethyl ether, monobutyl ether, glycerol ether and trimethylolpropane ether. These polyglycol oils are characterized by being sparingly hygroscopic and low reactive with a halogen-containing refrigerant to be described later.

The polyglycol oils used in this invention are those having a kinematic viscosity in the range of 50–200 cSt, preferably 100–200 cSt, at 98.9° C. (210° F.). The use of the polyglycol oil having a kinematic viscosity lower than said range will result in the production of a refrigerator oil having unsatisfactory sealability; on the other hand, the use of the polyglycol oil having a kinematic viscosity higher than said range will result in the production of a refrigerator oil which exhibits a high kinematic viscosity at ambient or low temperatures, is difficult to feed into a refrigerator and degrades the starting property of the refrigerator, thereby raising problems as to the operations of the refrigerator. The polyglycol oils used herein are those having a viscosity index of at least 150, preferably at least 200, while polyglycol having a viscosity index of less than 150 exhibit a high kinematic viscosity at ambient and low temperatures, thus causing the same troubles as mentioned above.

The satisfactory polyglycol oils as mentioned above may have an average molecular weight of at least 500, preferably 500–6000. Such oils are being marketed under the tradename of Newpol LB Series, Newpol HB Series and Sunnix Series by Sanyo Kasei Co., Ltd.

Further, polyglycol oils having a viscosity of at least 200 cSt at 98.9° C. may be used in such an amount that the base oil (A) according to this invention has a viscosity of 50–200 cSt at 98.9° C. and a viscosity index of at least 150.

The additive used in the high-viscosity refrigerator oil composition of this invention is at least one compound selected from the group consisting of (1) glycidyl ether type epoxy compounds, (2) epoxidized fatty acid monoesters and (3) epoxidized vegetable oils.

The glycidyl ether type epoxy compounds include phenyl- or alkylphenylglycidyl ethers and condensates of epichlorohydrin and bisphenol. The alkylphenylglycidyl ethers referred to herein contain 1 to 3 $C_4$–$C_{18}$ alkyl groups, preferably a $C_5$–$C_{10}$ alkyl group. The epichlorohydrinbisphenol condensates may be obtained preferably by condensing bisphenol A and epichlorohydrin for example; the preferable condensates include Epikote produced by Shell Chemical Co., Araldite produced by Ciba Geigy Co., DER produced by Dow Chemical Co., Epotack produced by Reichhold Co., Unox produced by UCC and Adeka Resin produced by Asahi Denka Co., these products being commercially available respectively under the aforesaid corresponding tradenames.

The epoxylated or epoxidized fatty acid monoesters include esters of an epoxidized $C_{12}$–$C_{20}$ fatty acid and a $C_1$–$C_8$ alcohol, phenol or an alkylphenol; particularly preferable are butyl-, hexyl-, benzyl-, cyclohexyl-, methoxyethyl-, octyl-, phenyl- and tertiary-butylphenyl esters of epoxidized stearic acid. These esters are illustrated by Adecacizer (tradename) produced by Adeka Argus Co., Drapex (tradename) produced by the same Company, Epocizer (tradename) produced by Dai Nippon Ink Chemical Co. and Kapox (tradename) produced by Kao Sekken Co., these products being marketed respectively under the aforementioned corresponding tradenames.

The epoxidized vegetable oils are illustrated by epoxy compounds of vegetable oils such as soybean oil, linseed oil and cottonseed oil; such epoxidized vegetable oils are marketed under the tradenames of "Adekacizer" (produced by Adeka Argus Co.), "Epocizer" (produced by Dai Nippon Ink Chemical Co.), "Newcizer" (produced by Nippon Yushi Co.), "Sansocizer" (produced by Shin Nippon Rika Co.) and the like.

The preferable additives used herein include glycidyl ether type epoxy compounds and epoxidized fatty acid monoesters, among which phenyl and alkylphenyl glycidyl ethers and epoxidized fatty acid monoesters are more preferable, and esters of epoxystearic acid with $C_1$–$C_8$ alcohols are the most preferable.

These additives may be used in amounts of 0.1–10%, preferably 1–5%, by weight of the total of the polyglycol oil and at least one additive used. The use of the additive or additives in an amount of less than 0.1% by weight will not fully be effective and the use thereof in an amount of more than 10% by weight will not significantly be further effective with an economical disadvantage involved.

The high-viscosity refrigerator oil composition of this invention may be incorporated with heretofore known additives for refrigerator oils, such as phenol or amine type antioxidants, sulphur or phosphorus type oiliness improves, silicone type antifoam agents and metal deactivators such as benzotriazole.

The high-viscosity refrigerator oil compositions of this invention are effective for compression type refrigerators, particularly for rotary type refrigerators. The rotary type refrigerators used herein include rotary vane type (movable vane type), fixed vane type (rotary piston type) and screw type ones. The high-viscosity refrigerator oil compositions of this invention are particularly effective or suitable for use in the screw type refrigerator.

Further, the oil compositions of this invention are particularly effective for use in refrigerators wherein a halogen-containing refrigerant. The halogen-containing refrigerants used herein are incombustible refrigerants prepared by substituting a hydrocarbon with chlorine or fluorine and are typified by FLON marketed under the tradename of Freon by Dupont, U.S.A. The refrigerants used herein include Freon 11, 12, 13, 22, 113, 114, 500 and 502. The refrigerator oil compositions of this invention are particularly effective or suitable for use in refrigerators wherein Freon 12 or 22 of said Freons is used as the refrigerant.

This invention will be better understood by the following Examples in comparison with the following Comparative examples.

The base oils, that is the polyglycol oils, and additives used in these Examples and Comparative examples are as follows.

Base oils

Polyoxypropylene glycol monobutyl ether:
Newpol LB-3000 produced by Sanyo Kasei Co.
Viscosity 105.9 cSt at 98.9° C., Viscosity index 237
Polyoxyethyleneoxypropylene glycol monobutyl ether A:
Newpol 50 HB-5100 produced by Sanyo Kasei Co.
Viscosity 150.4 cSt at 98.9° C., Viscosity index 277
Polyoxyethylene oxypropylene glycol monobutyl ether B:
Newpol 75 H-90000 produced by Sanyo Kasei Co.
Viscosity 3880 cSt at 98.9° C.
Poly-α-olefin:
Lipolub 750 produced by Lion Yushi Co.
Viscosity 64.4 cSt at 98.9° C., Viscosity index 167
Polybutene:
Polybutene HV-1000 produced by Nisseki Jyushi Kagaku Co.
Viscosity 2150 cSt at 98.9° C.

Additives

Epoxidized fatty acid monoester;
Drapex 3.2 (Octylepoxy stearate) produced by Adeka Argus Co.
Glycidyl ether:
Phenylglycidyl ether
Epoxidized vegetable oil:
Epocizer-W-100 EL produced by Dai Nippon Ink Co.

Test method

Kinetic viscosity: JIS (Japanese Industrial Standard) K 2283

Viscosity index: JIS K 2284 B method

Sealed tube test: A mixture of the oil and refrigerant (R-12) in the ratio by volume of 1:1, together with a copper-iron catalyst, is sealed up in a glass tube and heated to 150° C. for 240 hours, after which the whole is measured for discoloration. Assuming that dark brown color is given a value of 8 and colorlessness a value of zero, it is preferable that the degree of discoloration corresponds to a value of not more than 4. The oil used in the sealed tube test is then measured for viscosity.

The test results are shown in the following Tables 1 and 2.

TABLE 1

| | Refrigerator oil composition (wt. %) | | Kinematic viscosity (cSt) | | Viscosity index | Sealed tube test result | | |
|---|---|---|---|---|---|---|---|---|
| | Base oil | Additive | 37.8° C. | 98.9° C. | | Dis-coloration | Pre-cipitate | Kinematic viscosity cSt @ 98.9° C. |
| Example 1 | Polyoxypropylene glycol monobutyl ether (99.0) | Epoxidized fatty acid monoester (1.0) | 781.2 | 101.9 | 235 | 0 | None | 104.0 |
| Example 2 | Polyoxypropylene glycol monobutyl ether (99.0) | Glycidyl ether (1.0) | 787.5 | 100.6 | 231 | 0 | None | 101.0 |
| Example 3 | Polyoxypropylene glycol monobutyl ether (99.0) | Epoxidized vegetable oil (1.0) | 780.0 | 101.7 | 235 | 1 | None | 99.8 |
| Example 4 | Polyoxyethylene-oxypropylene glycol monobutyl ether A (95.0) | Epoxidized fatty acid monoester (5.0) | 806.9 | 125.5 | 269 | 0 | None | 142.0 |
| Example 5 | Polyoxyethylene-oxypropylene glycol monobutyl ether A (80.75) Polyoxyethylene-oxypropylene glycol monobutyl ether B (14.25) | Epoxidized fatty acid monoester (5.0) | 1206 | 186.9 | 289 | 0 | None | 191.0 |

TABLE 2

| | Refrigerator oil composition (wt. %) | | Kinematic viscosity (cSt) | | Viscosity index | Sealed tube test result | | |
|---|---|---|---|---|---|---|---|---|
| | Base oil | Additive | 37.8° C. | 98.9° C. | | Dis-coloration | Pre-cipitate | Kinematic viscosity cSt @ 98.9° C. |
| Comparative example 1 | Polyoxypropylene glycol monobutyl ether | — | 811.0 | 105.9 | 237 | 6 | Some | 55.6 |
| Comparative example 2 | Polyoxyethylene-oxypropylene glycol | — | 977.6 | 150.4 | 277 | More than 8 | Some | 51.4 |

TABLE 2-continued

| | Refrigerator oil composition (wt. %) | | Kinematic viscosity (cSt) | | Viscosity index | Sealed tube test result | | |
|---|---|---|---|---|---|---|---|---|
| | Base oil | Additive | 37.8° C. | 98.9° C. | | Dis-coloration | Pre-cipitate | Kinematic viscosity cSt @ 98.9° C. |
| | monobutyl ether A | | | | | | | |
| Comparative example 3 | Polyoxypropylene glycol monobutyl ether (99.5) | Dibutyl tin stearate (0.5) | 793.1 | 102.0 | 233 | 1 | Some | 112.3 |
| Comparative example 4 | Polyoxypropylene glycol monobutyl ether (99.4) | Antioxidant (0.6) | 807.5 | 105.3 | 236 | 6 | Some | 61.38 |
| Comparative example 5 | Poly-α-olefin + (80) polybutene (20) | — | 1598 | 106.3 | 160 | 2 | Some | 108.0 |

The compositions obtained in Examples 1–5 are high-viscosity refrigerator oil compositions of this invention.

TABLE 3

| | Condition of operation | Kinematic viscosity of original oil (cSt) | | Kinematic viscosity of used oil (cSt) | |
|---|---|---|---|---|---|
| | | 37.8° C. | 98.9° C. | 37.8° C. | 98.9° C. |
| Example 1 | Satisfactory | 781.2 | 101.9 | 789 | 99 |
| Comparative example 1 | Satisfactory at initial stage, but unsatisfactory with the lapse of time | 811.0 | 105.9 | 471 | 62 |
| Comparative example 5 | Safe operation impossible from the start | 1598 | 106.3 | — | — |

In the sealed tube test, these oil compositions exhibited slight discoloration as compared with the oil or oil composition obtained in the Comparative examples and they produced no precipitates. Further, even after the sealed tube test, they exhibited only a slight decrease in viscosity and were considered to have excellent sealability.

The oils obtained in Comparative examples 1–2 were a polyglycol oil without any additives, and the oil obtained in Comparative example 4 was a polyglycol oil incorporated with an antioxidant (D.B.P.C.). All of said comparative oils exhibited discoloration, produced precipitates and decreased in kinematic viscosity at 98.9° C. in the sealed tube test.

The oil composition obtained in Comparative example L3 was one incorporated with dibutyl tin stearate as a dehydrochlorinating agent did not decrease in kinematic viscosity but produced precipitates in the sealed tube test.

The oil composition obtained in Comparative example 5 was one prepared from a poly-α-olefin and polybutene and exhibited a performance next to those of the oil compositions obtained in the Examples in the sealed tube test, however, it did not permit a refrigerator to operate safe from the start when used in the refrigerator as described later.

Furthermore, the oil compositions obtained in Example 1, Comparative examples 1 and 5 were subjected to a test over a time period of 1000 hours by the use of a small-sized, screw type refrigerator. The results were as shown in Table 3.

From this Table it is seen that the oil composition of Example 1 little decreased in kinematic viscosity and retained high sealability for the refrigerator during the test. The oil composition of Comparative example 1 retained satisfactory sealability at the initial stage of the test, however, it decreased in sealability with the lapse of time and also decreased in kinematic viscosity after the test. The oil composition of Comparative example 5 did not permit the refrigerator to operate safe from the start of the test.

What is claimed is:

1. A high-viscosity refrigerator oil composition consisting essentially of:

(A) 90–99.9% by weight of a polyglycol oil having a kinematic viscosity of 50–200 cSt at 98.9° C. and a viscosity index of at least 150, represented by the following formula $$R_1\text{-}[O\text{—}(R_2O)_m\text{—}R_3]_n$$

wherein $R_1$ and $R_3$ are each a hydrogen atom, hydrocarbon radical or fatty acyl group and they may be identical with, or different from, each other, $R_2$ is an alkylene group, n is an integer of 1–6 and mxn equals at least 30, and (B) 0.1–10% by weight of at least one member selected from the group consisting of (1) glycidyl ether epoxy compounds, (2) epoxidized fatty acid monoesters and (3) epoxidized vegetable oils.

2. A high-viscosity refrigerator oil composition according to claim 1, wherein the polyglycol oil is a member selected from the group consisting of a polyoxypropylene glycol, a polyoxyethylene-polyoxypropylene glycol, and a monomethyl, monobutyl, glycerol or trimethylolpropane ether thereof.

3. A high-viscosity refrigerator oil composition according to claim 2, wherein the glycidyl ether epoxy compound is a member selected from the group consisting of phenylglycidyl ether, an alkylphenylglycidyl ether and a condensate of epichlorohydrin and bisphenol.

4. A high-viscosity refrigerator oil composition according to claim 3, wherein the alkylphenylglycidyl ether contains 1 to 3 $C_4$–$C_{18}$ alkyl groups.

5. A high-viscosity refrigerator oil composition according to claim 1, wherein the epoxidized fatty acid monoester is a member selected from the group consisting of ester of an epoxidized $C_{12}$–$C_{20}$ fatty acid with a $C_1$–$C_8$ alcohol, phenol or an alkylphenol.

6. A high-viscosity refrigerator oil composition according to claim 1, wherein the epoxidized fatty acid monoester is a butyl, hexyl, benzyl, cyclohexyl, methoxyethyl, octyl, phenyl or t.-butylphenyl ester of epoxidized stearic acid.

7. A high-viscosity refrigerator oil composition according to claim 1, wherein the epoxidized vegetable oil is an epoxidized soybean oil, linseed oil or cottonseed oil.

* * * * *